US011808038B2

(12) United States Patent
DePaul

(10) Patent No.: US 11,808,038 B2
(45) Date of Patent: Nov. 7, 2023

(54) CEILING PANEL ATTACHMENT ASSEMBLY

(71) Applicant: ARMSTRONG WORLD INDUSTRIES, INC., Lancaster, PA (US)

(72) Inventor: Marie A. DePaul, Downingtown, PA (US)

(73) Assignee: AWI Licensing LLC, Wilmington, DE (US)

( * ) Notice: Subject to any disclaimer, the term of this patent is extended or adjusted under 35 U.S.C. 154(b) by 57 days.

(21) Appl. No.: 17/409,342

(22) Filed: Aug. 23, 2021

(65) Prior Publication Data

US 2022/0056689 A1 Feb. 24, 2022

Related U.S. Application Data

(60) Provisional application No. 63/069,372, filed on Aug. 24, 2020.

(51) Int. Cl.
*E04B 9/24* (2006.01)
*E04B 9/04* (2006.01)

(52) U.S. Cl.
CPC ..... *E04B 9/248* (2013.01); *E04B 9/04* (2013.01)

(58) Field of Classification Search
CPC ..... E04B 9/248; E04B 9/04
See application file for complete search history.

(56) References Cited

U.S. PATENT DOCUMENTS

| | | | | |
|---|---|---|---|---|
| 3,378,974 | A * | 4/1968 | Bush, Jr. | E04F 13/0883 52/506.05 |
| 3,384,934 | A * | 5/1968 | Bush, Jr. | F16B 25/0005 24/356 |
| 4,486,995 | A | 12/1984 | Allen | |
| 5,414,969 | A | 5/1995 | Krejci | |
| 7,798,287 | B1 * | 9/2010 | Surace | E04B 9/0435 181/290 |
| 10,407,904 | B2 | 9/2019 | Gillette | |
| 10,508,444 | B2 | 12/2019 | Gillette | |
| 10,584,488 | B2 | 3/2020 | Gillette | |
| 2005/0167034 | A1 * | 8/2005 | Gearhart | B60R 13/02 156/212 |
| 2007/0003791 | A1 * | 1/2007 | Rochette | B44C 5/04 427/256 |
| 2016/0236444 | A1 | 8/2016 | Immordino | |

(Continued)

FOREIGN PATENT DOCUMENTS

| | | | |
|---|---|---|---|
| EP | 1489241 | A1 | 12/2004 |
| EP | 1614827 | A1 | 1/2006 |

(Continued)

OTHER PUBLICATIONS

International Search Report for related patent application PCT/US2021/047157 dated Dec. 17, 2021.

*Primary Examiner* — Patrick J Maestri
(74) *Attorney, Agent, or Firm* — Patrick Sheldrake

(57) ABSTRACT

Described herein is a method of installing a ceiling system comprising adhesively bonding together a ceiling panel and a magnetic attachment element to form a ceiling panel assembly, magnetically coupling the ceiling panel assembly to at least one suspended support element; and wherein the ceiling panel and the magnetic attachment element are adhesively bonded together a the time of installation.

19 Claims, 8 Drawing Sheets

(56) References Cited

U.S. PATENT DOCUMENTS

| | | | |
|---|---|---|---|
| 2017/0086580 | A1 | 3/2017 | Conti |
| 2018/0127976 | A1 | 5/2018 | Gillette |
| 2019/0368193 | A1 | 12/2019 | Morgan |
| 2019/0368194 | A1 | 12/2019 | Gillette |

FOREIGN PATENT DOCUMENTS

| | | | | |
|---|---|---|---|---|
| JP | 56-014134 | U | 2/1981 | |
| KR | 10-2008-0102821 | | 11/2008 | |
| WO | WO-2019040984 | A1 * | 3/2019 | ..... B65D 90/043 |

* cited by examiner

CEILING PANEL ATTACHMENT ASSEMBLY

CROSS-REFERENCE TO RELATED APPLICATIONS

This application claims the benefit of U.S. Provisional Application No. 63/069,372, filed on Aug. 24, 2020. The disclosure of the above application(s) is (are) incorporated herein by reference.

BACKGROUND

Building panels—specifically ceiling panels—are required to meet strict safety standards to ensure proper resistance to flame and smoke formation during a fire. Meeting such safety requirements often creates setbacks in achieving the desired aesthetic and/or structure properties for that panel. Thus, a need exists for building panel that can not only exhibit improved resistance to flame and smoke formation, but also exhibit the desired aesthetic and structural properties.

BRIEF SUMMARY

In some embodiments, the present invention is directed to a ceiling system comprising: at least one support member comprising a lower support surface; at least one ceiling panel assembly comprising: a ceiling panel comprising a porous body having a first major surface opposite a second major surface and a side surface extending there-between, the porous body having a body thickness as measured between the first and second major surfaces; a magnetic attachment element; an adhesive; wherein the adhesive couples the magnetic attachment element to the first major surface of the porous body, and the adhesive penetrates into the porous body at a first depth as measured from the first major surface, the first depth being about 1% to about 33% of the body thickness; wherein the at least one ceiling panel is secured in place within the ceiling system by a magnetic engagement between the magnetic attachment element and the at least one support member.

Other embodiments of the present invention include a ceiling panel assembly comprising: a ceiling panel comprising a porous body having a first major surface opposite a second major surface and a side surface extending there-between, the porous body having a body thickness as measured between the first and second major surfaces; a magnetic attachment element; an adhesive; wherein the adhesive couples the magnetic attachment element to the first major surface of the porous body, and the adhesive penetrates into the porous body at a depth as measured from the first major surface, the depth being about 1% to about 33% of the body thickness; wherein porous body comprises a network of open pathways extending between the first major surface, the second major surface, and the side surface, and wherein the adhesive occupies at least a first portion of the network of open pathways of the porous body.

Other embodiments of the present invention include a method of installing a ceiling system comprising: a) adhesively bonding together a ceiling panel and a magnetic attachment element to form a ceiling panel assembly; b) magnetically coupling the ceiling panel assembly to at least one suspended support element; wherein the ceiling panel and the magnetic attachment element are adhesively bonded together a the time of installation.

Other embodiments of the present invention include a method of forming a ceiling panel assembly comprising: a) applying an adhesive in a first state to an outer surface of a ceiling panel in a first region; b) contacting a magnetic attachment element with the outer surface of the ceiling panel and the adhesive within the first region; c) mechanically coupling together the ceiling panel and the magnetic attachment element with a fastener, the fastener at least partially extending through the first region such that the fastener contacts the adhesive in the first state; and d) curing the adhesive such that the adhesive transitions from the first state to a second state to form the ceiling panel assembly; wherein the first state of the adhesive is an uncured state and the second state of the adhesive is a cured state.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

Figure 1:
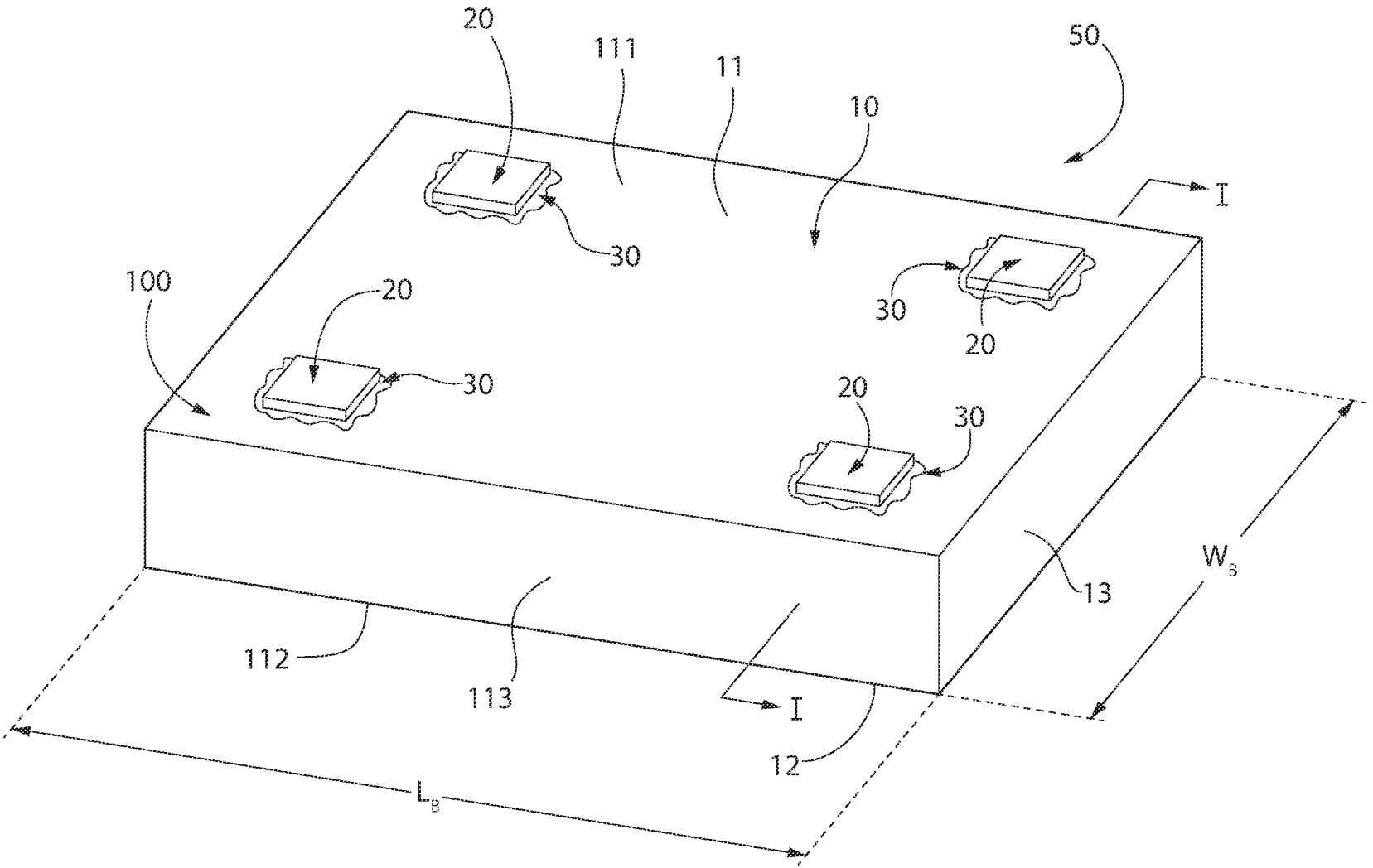
FIG. 1 is a perspective view of an ceiling panel assembly according to the present invention.

The following description of the preferred embodiment(s) is merely exemplary in nature and is in no way intended to limit the invention, its application, or uses.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

Unless otherwise specified, all percentages and amounts expressed herein and elsewhere in the specification should be understood to refer to percentages by weight. The amounts given are based on the active weight of the material.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top," and "bottom"

as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such.

Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

Unless otherwise specified, all percentages and amounts expressed herein and elsewhere in the specification should be understood to refer to percentages by weight. The amounts given are based on the active weight of the material. According to the present application, the term "about" means +/−5% of the reference value. According to the present application, the term "substantially free" less than about 0.1 wt. % based on the total of the referenced value.

Figure 2:
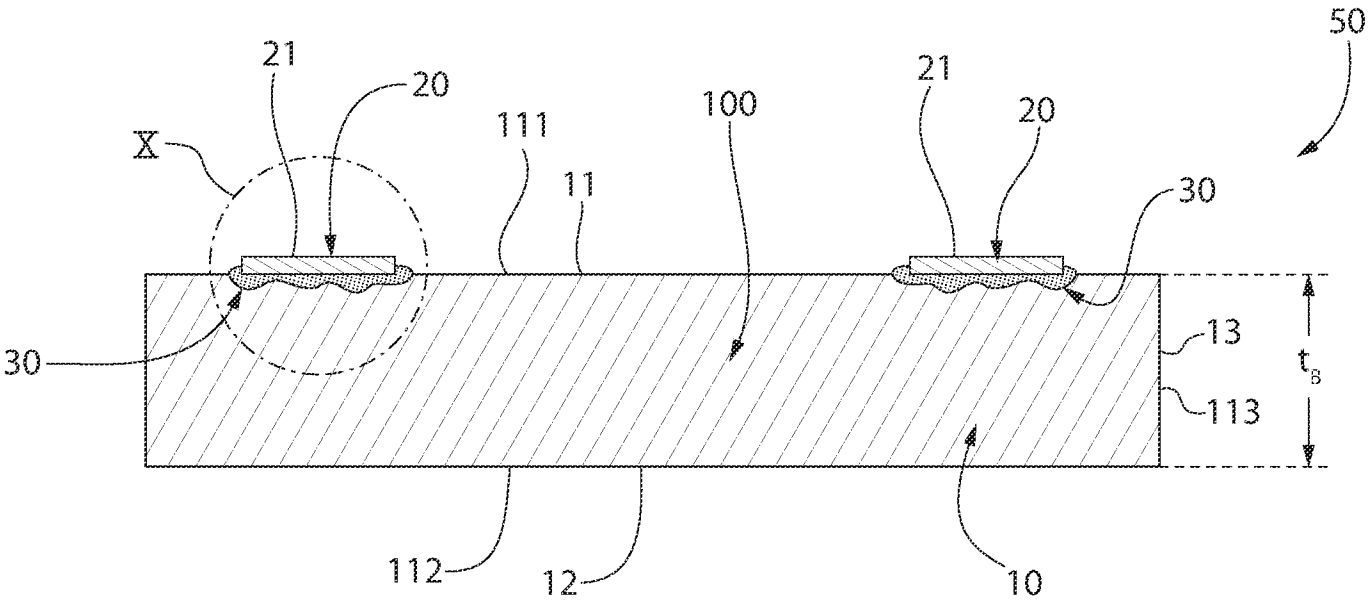
FIG. 2 is a cross-sectional view of the acoustic building panel of FIG. 1 along lines I-I of FIG. 1.
Figure 3:
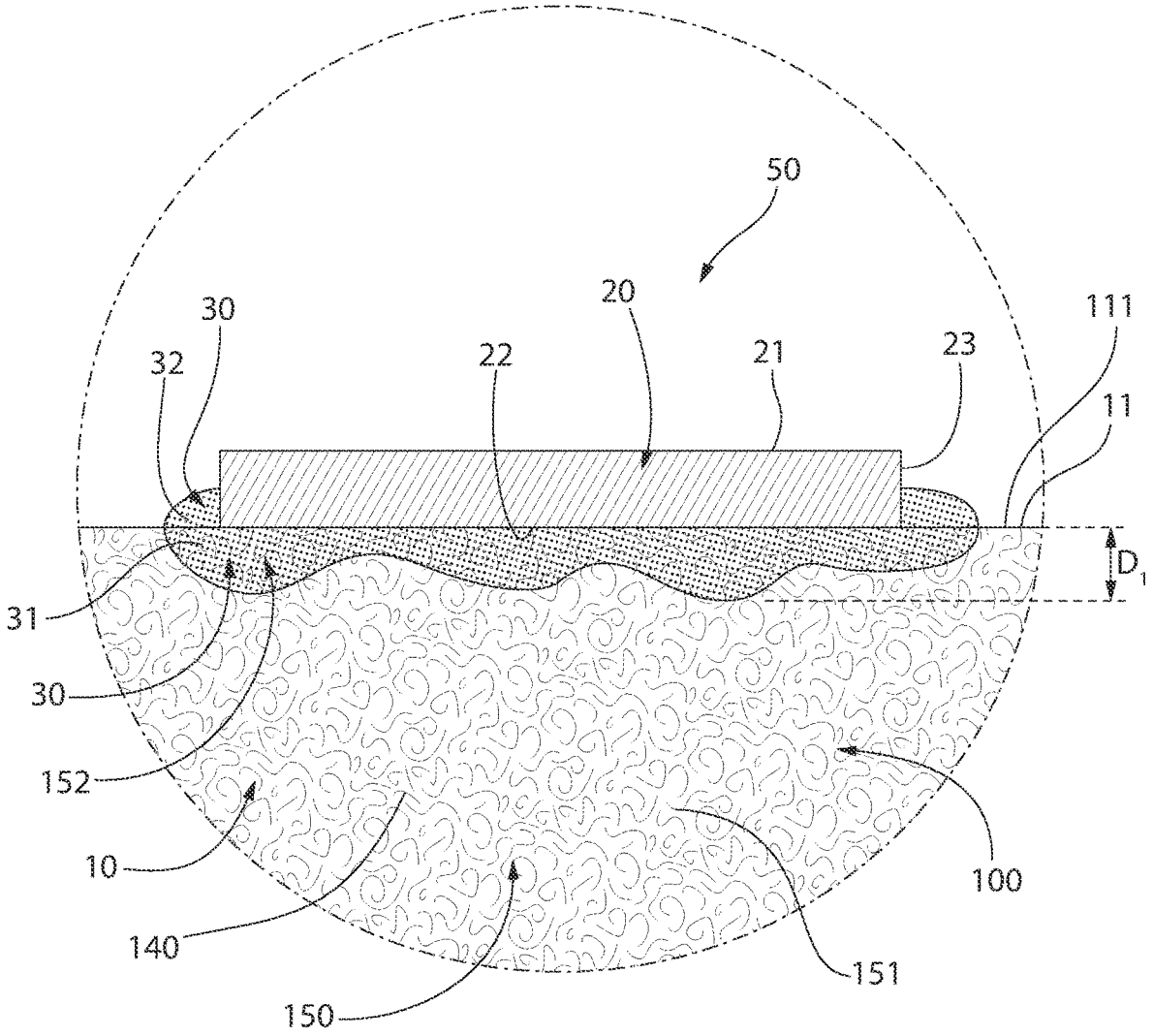
FIG. 3 is a close-up view of the portion X of FIG. 2.
Figure 4:
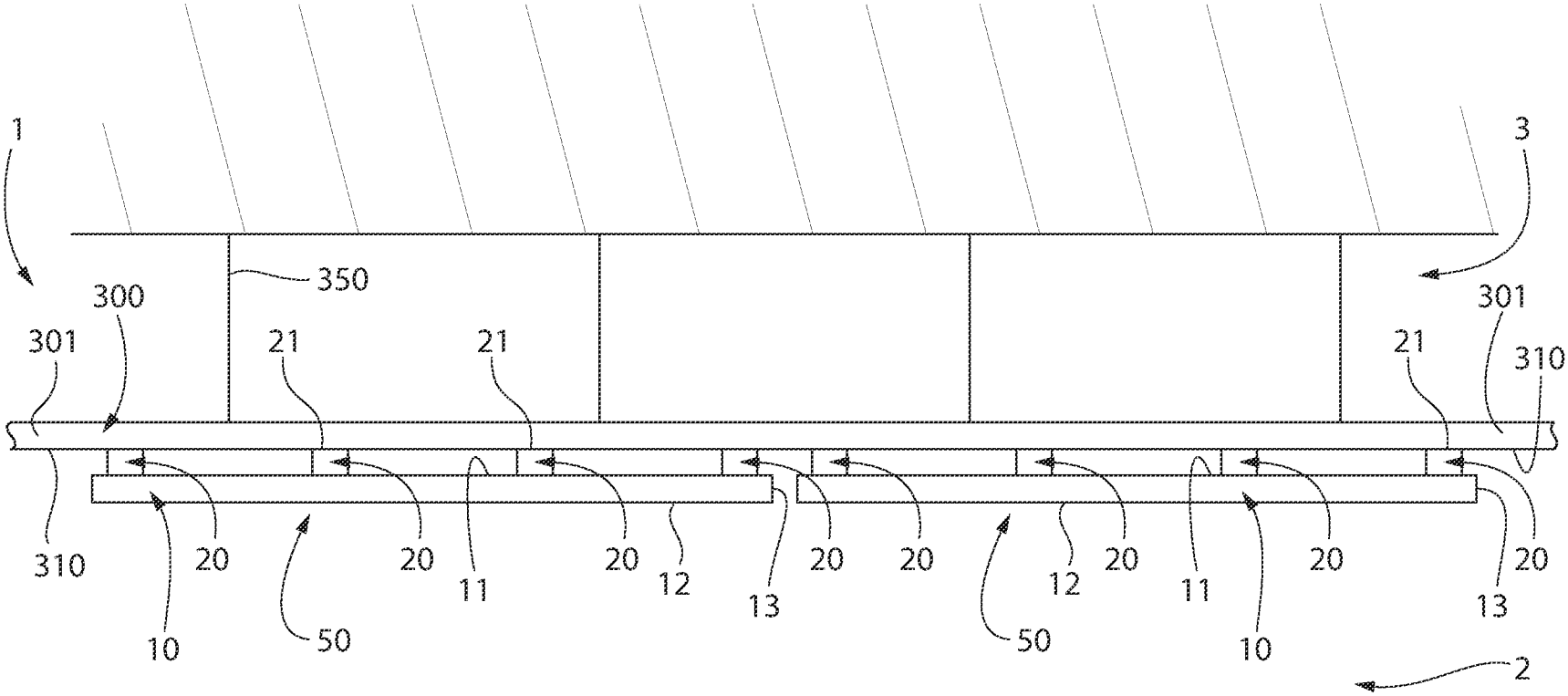
FIG. 4 is an elevation view of a building system comprising the ceiling panel assembly of the present disclosure.
Figure 5:
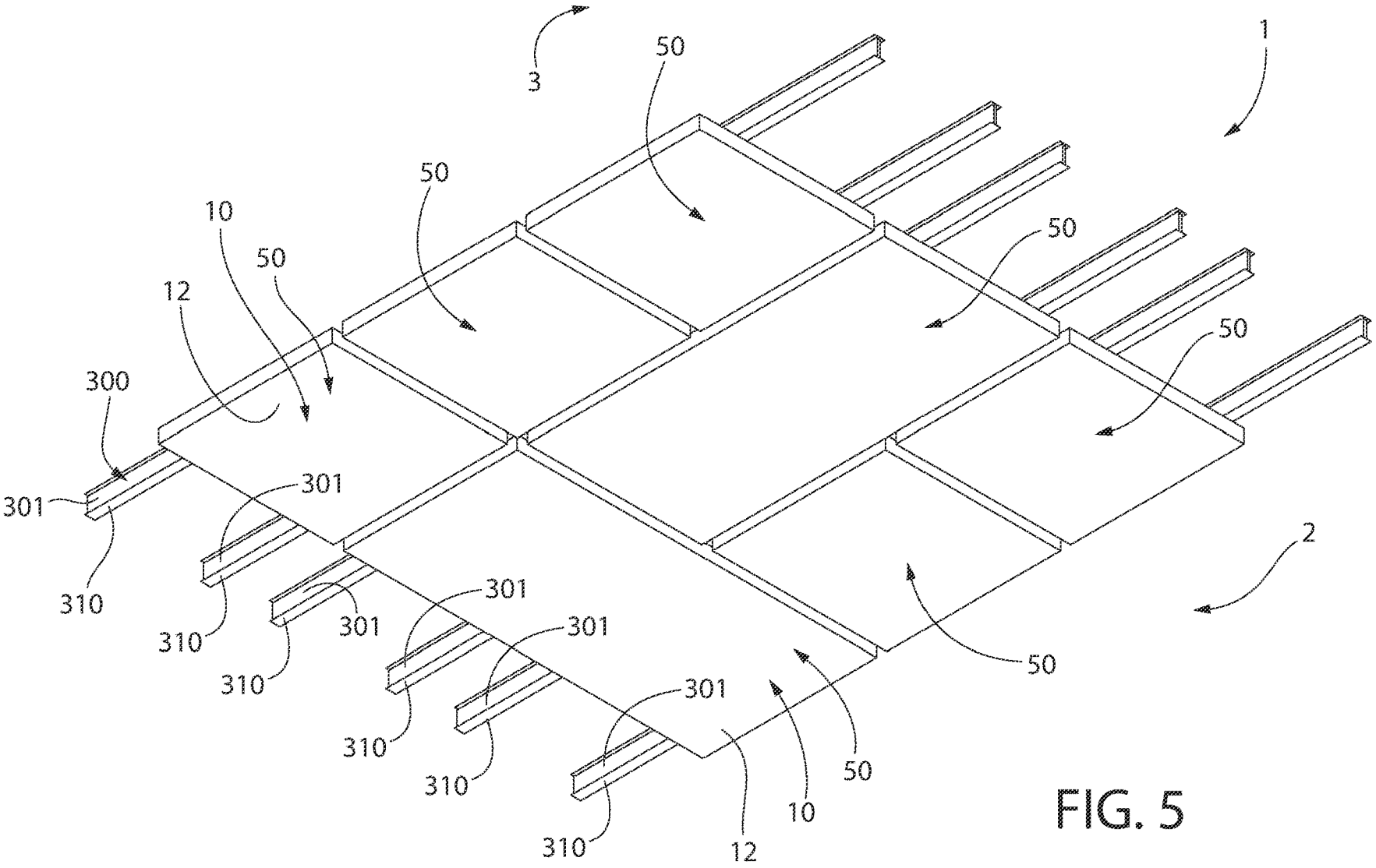
FIG. 5 is a perspective view of a building system comprising the ceiling panel assembly of the present disclosure.

Referring to FIGS. 1-3, the present disclosure is directed to a building panel assembly 50 (also referred to as a "ceiling panel assembly" 50), which comprises a building panel 10 (also referred to as a "ceiling panel"), a magnetic attachment element 20, and an adhesive 40. Referring to FIGS. 4-5, the present disclosure is directed to a building system 1 comprising at least one of the building panel assemblies 50. In some embodiments of the present invention, the building system 1 may be a ceiling system 1—therefore, the term "ceiling system" may be used throughout, but the present invention is not limited to ceiling applications. Rather, the subsequent discussion may also apply to other building systems, such as wall systems, interior decorative systems, and the like. The term "ceiling panel" 10 may be used interchangeably with the term "building panel," however, the present invention is not limited to ceiling panels. The term "ceiling panel assembly" 50 may be used interchangeably with the term "building panel assembly," however, the present invention is not limited to ceiling panel assemblies. Rather the subsequent discussion may, for example, also apply to wall panels.

As discussed in greater detail herein, the ceiling panel 10 of the present invention may be an acoustic ceiling panel 10. As discussed in greater detail herein, the ceiling panel 10 of the present invention may be flame resistant ceiling panel 10. The ceiling panel 10 of the present invention may be a flame resistant acoustic ceiling panel 10.

Referring now to FIGS. 1-3, the ceiling panel 10 may comprise a first exposed major surface 11 that is opposite a second exposed major surface 12. The ceiling panel 10 may comprise an exposed side surface 13 that extends between the first and second exposed major surfaces 11, 12. The ceiling panel 10 may have a panel thickness as measured by the distance between the first major exposed surface 11 and the second major exposed surface 12.

The ceiling panel 10 may comprise a body 100. The body 100 may comprise a first major surface 111 that is opposite a second major surface 112. The body 100 may comprise a side surface 113 that extends between the first and second major surfaces 111,112 of the body 100. The side surface 113 may form a perimeter of the body 100.

The body 100 may have a body length $L_B$ ranging from about 60 cm to about 310 cm—including all lengths and sub-ranges there-between. In some embodiments, the body length $L_B$ may range from about 75 cm to about 250 cm—including all lengths and sub-ranges there-between. In some embodiments, the body length $L_B$ may range from about 104 cm to about 230 cm—including all lengths and sub-ranges there-between. In some embodiments, the body length $L_B$ may range from about 104 cm to about 110 cm—including all lengths and sub-ranges there-between. In some embodiments, the body length $L_B$ may range from about 210 cm to about 230 cm—including all lengths and sub-ranges there-between.

The body 100 may have a body width $W_B$ ranging from about 60 cm to about 130 cm—including all widths and sub-ranges there-between. In some embodiments, the body width $W_B$ may range from about 75 cm to about 130 cm—including all widths and sub-ranges there-between. In some embodiments, the body width $W_B$ may range from about 100 cm to about 120 cm—including all lengths and sub-ranges there-between.

The body 100 may have a body thickness $t_B$ as measured by the distance spanning between the first major surface 111 and the second major surface 112. The body thickness $t_B$ may range from about 18 mm to about 27 mm—including all thicknesses and sub-ranges there-between. In some embodiments, the body thickness $t_B$ may range from about 19 mm to about 26 mm—including all lengths and sub-ranges there-between. In some embodiments, the body thickness $t_B$ may range from about 22 mm to about 25 mm—including all lengths and sub-ranges there-between. In some embodiments, the body thickness $t_B$ may be about 25.4 mm.

According to the present invention, a ratio of the body length $L_B$ to the body thickness $t_B$ may be at least 24:1. According to the present invention, a ratio of the body length $L_B$ to the body thickness $t_B$ may be at least 35:1. In some embodiments, the ratio of the body length $L_B$ to the body thickness $t_B$ may be at least 40:1. In some embodiments, the ratio of the body length $L_B$ to the body thickness $t_B$ may be at least 80:1.

In some embodiments of the present invention, the ratio of the body length $L_B$ to the body thickness $t_B$ may range from about 35:1 to about 172:1—including all ratios and sub-ranged there-between. In some embodiments of the present invention, the ratio of the body length $L_B$ to the body thickness $t_B$ may range from about 35:1 to about 133:1—including all ratios and sub-ranged there-between. In some embodiments of the present invention, the ratio of the body length $L_B$ to the body thickness $t_B$ may range from about 40:1 to about 120:1—including all ratios and sub-ranges there-between. In some embodiments of the present invention, the ratio of the body length $L_B$ to the body thickness $t_B$ may range from about 40:1 to about 50:1—including all ratios and sub-ranged there-between. In some embodiments of the present invention, the ratio of the body length $L_B$ to the body thickness $t_B$ may range from about 85:1 to about 95:1—including all ratios and sub-ranged there-between.

According to the present invention, a ratio of the body width $W_B$ to the body thickness $t_B$ may be at least 24:1. In some embodiments, the ratio of the body width $W_B$ to the body thickness $t_B$ may be at least 30:1. In some embodiments, the ratio of the body width $W_B$ to the body thickness $t_B$ may be at least 35:1. In some embodiments, the ratio of the body width $W_B$ to the body thickness $t_B$ may be at least 40:1. In some embodiments of the present invention, the ratio of the body width $W_B$ to the body thickness $t_B$ may range from about 35:1 to about 50:1—including all ratios and sub-ranged there-between. In some embodiments of the present invention, the ratio of the body width $L_B$ to the body thickness $t_B$ may range from about 40:1 to about 45:1—including all ratios and sub-ranged there-between.

The first major exposed surface 11 of the ceiling panel 100 may comprise the first major surface 111 of the body 100. The second major exposed surface 12 of the ceiling panel 10 may comprise the second major surface 112 of the body 100. According to the embodiments where the first major exposed surface 11 of the ceiling panel 10 comprises the first major surface 111 of the body 100 and the second major exposed surface 12 of the ceiling panel 10 comprises the second major surface 112 of the body 100, the panel thickness may be substantially equal to the body thickness $t_B$.

In some embodiments, the ceiling panel 10 may further comprise a scrim. The scrim or facing sheet may be formed of a non-woven material. In a non-limiting example, the non-woven material may be fiberglass. The scrim may have a scrim thickness ranging from about 0.2 mm to about 0.4 mm—including all thickness and sub-ranges there-between. The scrim may be coupled to the second major surface 112 of the body 100. The scrim may be coupled by adhesive, fastener, and the like.

According to the embodiments where the ceiling panel 10 comprises a scrim coupled to the second major surface 112 of the body 100 and the first major exposed surface 11 of the ceiling panel 10 comprises the first major surface 111 of the body 100, the panel thickness may be substantially equal to the summation of the body thickness $t_B$ and the scrim thickness. In such embodiments, the first major exposed surface 11 of the ceiling panel 10 may be formed by the scrim. Stated otherwise, the first major exposed surface 11 of the ceiling panel 10 may comprise the scrim.

The body 100 may be formed of a fibrous material 140. The fibrous material 140 may be present in the body 100 an amount ranging from about 90.0 wt. % to about 99.9 wt. % based on the total weight of the body 100—including all weight percentages and sub-ranges there-between. In a preferred embodiment, the fibrous material 140 may be present in the body 100 an amount ranging from about 95.0 wt. % to about 99.9 wt. % based on the total weight of the body 100—including all weight percentages and sub-ranges there-between.

The fibrous material 140 may comprise a plurality of fibers having an average fiber length ranging from about 25 mm to about 100 mm—including all fiber lengths and sub-ranges there-between. The fibrous material 140 may comprise a plurality of fibers having an average fiber diameter ranging from about 4 denier to about 15 denier—including all fiber diameters and sub-ranges there-between. A denier is a unit of measure within the fiber arts that equates to one gram of mass per 9,000 meters of length.

The fibrous material 140 may comprise a plurality of fibers having a substantially straight geometry, whereby the fibers extend substantially straight. In some embodiments, the fibrous material 140 may comprise a plurality of fibers having a crimped geometry, whereby the fibers have a planar zig-zag and/or spiral shape. In some embodiment, the fibers may comprise a zig-zag shape. In some embodiments, the fibers may have a spiral shape.

The fibrous material 140 may comprise an organic fiber. The organic fiber may be a synthetic organic fiber. The organic fiber may be present in an amount ranging from about 95 wt. % to about 100 wt. % based on the total weight of the fibrous material 140—including all weight percentages and sub-ranges there-between. In some embodiments, the organic fiber may be present in an amount of at least 99 wt. % based on the total weight of the fibrous material 140—including all weight percentages and sub-ranges there-between. In some embodiments, the organic fiber may be about 100 wt. % of the fibrous material 140.

In some embodiments, the fibrous material 140 consists essentially of organic fiber. In some embodiments, the fibrous material 140 consists of organic fiber. In some embodiments, the fibrous material 140 is substantially free of inorganic fiber. In some embodiments, the body 100 is substantially free of inorganic fiber.

In some embodiments, the fibrous material 140 consists essentially of synthetic organic fiber. In some embodiments, the fibrous material 140 consists of synthetic organic fiber. In some embodiments, the fibrous material 140 is substantially free of inorganic fiber. In some embodiments, the body 100 is substantially free of inorganic fiber. In some embodiments, the fibrous material 140 is substantially free of natural organic fiber. In some embodiments, the body 100 is substantially free of natural organic fiber.

The term "natural organic fiber" may refer to naturally occurring fiber—such as, but not limited to, cellulosic fiber (also referred to as "cellulose" fiber).

The synthetic organic fiber may be a polymeric fiber. The polymeric fiber may be formed of a thermoplastic polymer. The polymeric fiber may be a polyester fiber. The polyester fiber may be formed from thermoplastic polyester. In other embodiments, the polymeric fiber may be formed by one or more thermoplastic polymers such as, but not limited to olefinic polymers, e.g., polyethylene and polypropylene; polyamide, e.g., nylon 6 and nylon 6,6; thermoplastic elastomers, e.g., SBS and ABS, and the like. In some embodiments, a portion of the polymeric fiber may be formed from thermoset polymer.

In some embodiments, the polyolefin may be from ethylene polymers, such as high-density polyethylene ("HDPE"); medium-density polyethylene ("MDPE"); low-density polyethylene ("LDPE"); and linear low-density polyethylene ("LLDPE").

The polyester fiber may be present in an amount ranging from about 95.0 wt. % to about 100 wt. % based on the total weight of the fibrous material 140—including all weight percentages and sub-ranges there-between. The polyester fiber may be present in an amount of at least about 70 wt. % based on the total weight of the fibrous material 140. In some embodiments, the polyester fiber may be present in an amount of at least about 99 wt. % based on the total weight of the fibrous material 140. In some embodiments, the polyester fiber may be about 100 wt. % of the fibrous material 140.

Non-limiting examples of polyester fiber include fibers formed of polymeric material selected from one or more of terephthalate polymers, such as polyethylene terephthalate ("PET"), polybutylene terephthalate ("PBT"), polyethylene terephthalate glycol ("PETG"), glycol-modified PBT, and the like.

The polyester polymer that forms the polyester fiber may have a glass transition temperature ranging from about 70° C. to about 85° C.—including all temperatures and sub-ranges there-between. The polyester polymer that forms the polyester fiber may have a melt temperature ranging from about 110° C. to about 295° C.—including all temperatures and sub-ranges there-between.

In some embodiments, the polyester fiber may be a single component fiber formed entirely of a single polyester polymer. In other embodiments, the polyester fiber may be a bicomponent fiber formed of two different polyester polymers (i.e., a first polyester polymer and a second polyester polymer). The first polyester may have a first melt temperature ranging from about 245° C. to about 255° C.—including all temperatures and sub-ranges there-between. The second polyester may have a second melt temperature ranging from about 255° C. to about 265° C.—including all temperatures and sub-ranges there-between. Independent of the melt temperature ranges recited above, the first melt temperature may be equal to about 90% to about 97% the second melt temperature—including all percentages and sub-ranges there-between.

The bicomponent fiber may have a side-by-side configuration or a core sheath configuration. In the core-sheath configuration, the first polyester polymer forms the core and the second polyester forms the sheath that at least partially surrounds the core. In the core-sheath configuration, the bicomponent fiber may comprise one or more fibers that is a concentric sheath-core (symmetrical core sheath) or an eccentric sheath-core (asymmetrical core-sheath).

In the bicomponent fibers, the first polyester may be present in an amount ranging from about 25 wt. % to about 75 wt. % of the bicomponent fiber and the second polyester being present in an amount ranging from about 75 wt. % to about 25 wt. %—wherein both amounts are based on the total weight of the bicomponent fiber and include all amounts and sub-ranges there-between.

The body 100 may further comprise at least one additional component selected from fire retardants, finishing oils, and/or colorants. The additional component may be present in an amount ranging from about 0.1 wt. % to about 10.0 wt. % based on the total weight of the body—including all amounts and sub-ranges there-between. In some embodiments, the additional component may be present in an amount ranging from about 0.1 wt. % to about 5.0 wt. % based on the total weight of the body—including all amounts and sub-ranges there-between.

The sum of the weight of the fibrous material and the additional component may be equal to 100 wt. % of the body 100. The body 100 may consist essentially of the fibrous material and the additional component. The body 100 may consist of the fibrous material and the additional component.

The fire retardant may be present in an amount ranging from about 0.1 wt. % to about 5.0 wt. % based on the total weight of the body 100—including all amounts and sub-ranges there-between. In some embodiments, the fire retardant may be present in an amount ranging from about 0.5 wt. % to about 4.0 wt. % based on the total weight of the body 100—including all amounts and sub-ranges there-between. Non-limiting examples of fire retardant may include non-halogenated phorphorous containing compounds, phosphine oxides, phosphinates, phosphonates, phosphates, and mixtures thereof.

The finishing oil may be present in an amount ranging from about 0.1 wt. % to about 5.0 wt. % based on the total weight of the body 100—including all amounts and sub-ranges there-between. Non-limiting examples of finishing oil may include one or more fiber lubricant compounds.

The colorant be present in an amount ranging from about 0.1 wt. % to about 2.0 wt. % based on the total weight of the body 100—including all amounts and sub-ranges there-between. Non-limiting examples of colorant may include dyes, pigments, and combinations thereof. Non-limiting examples of pigments may include titanium dioxide, carbon black, and mixtures thereof. Other non-limiting examples of colorants include 2,2-(Vinylenedi-p-phenylene) bisbenzoxazole; Copper Phthalocyanine; Diiron trioxide; 1,1'-((6-Phenyl-1,3,5-triazine-2,4-diyl)diimino)bis-9,10-antharcenedione; and combinations thereof.

The colorant may be white, black, grey, and any color within the color spectrum. According to the present invention the term "color" may include colors of the visible light spectrum (e.g., red, orange, yellow, green, cyan, blue, violet, brown, etc.) as well as white, black, and grey. In a non-limiting example, the body may be white and the colorant may be titanium dioxide. In a non-limiting example, the body may be black and the colorant may be carbon black. In a non-limiting example, the body may be white and the colorant may be grey and a blend of titanium dioxide and carbon black.

The body 100 may be porous—also referred to as a "porous body" 100. The porous body 100 may allow for air and water vapor to flow between the first major surface 111, the second major surface 112, and/or the side surface 113. The body 100 may be porous enough that it allows for enough airflow through the body 100 under atmospheric conditions for the ceiling panel 100 to function as an acoustic ceiling panel, which requires properties related to noise reduction and sound attenuation properties—as discussed further herein.

Specifically, the body 100 of the present invention may have a porosity ranging from about 90.0% to about 97.0%-including all values and sub-ranges there between. In a preferred embodiment, the body 100 has a porosity ranging from about 91% to 94%-including all values and sub-ranges there between. According to the present invention, porosity refers to the following:

$$\%\ \text{Porosity}=[V_{Total}-(V_F+V_{AC})]/V_{Total}$$

Where $V_{Total}$ refers to the total volume of the body 100 defined by the first major surface 111, the second major surface 112, and the side surfaces 113. $V_F$ refers to the total volume occupied by the fibrous material in the body 100. $V_{AC}$ refers to the total volume occupied by the additional components in the body 100. Thus, the % porosity represents the amount of free volume within the body 100.

The porous nature of the body 100 may result in a network of open pathways 150 that exist as voids between the $V_F$ and $V_{AC}$. The network of open pathways 150 may be fluidly coupled and allow for the airflow through the body 100 between at least the first major surface 111 and the second major surface 112 and/or the side surface 113. As discussed in greater detail herein, the body 100 may comprise a first portion 151 of the network of open pathways 150 that are empty—whereby the term "empty" refers to first portion 151 of the network of open pathways 150 being substantially free of a substance other than the fibrous material 140 or additional components that make up the body 100.

The building panel 10 of the present invention comprising the porous body 100 may exhibit sufficient airflow for the building panel 10 to have the ability to reduce the amount of reflected sound in a room. The reduction in amount of reflected sound in a room is expressed by a Noise Reduction Coefficient (NRC) rating as described in American Society for Testing and Materials (ASTM) test method C423. This rating is the average of sound absorption coefficients at four ¼ octave bands (250, 500, 1000, and 2000 Hz), where, for example, a system having an NRC of 0.90 has about 90% of the absorbing ability of an ideal absorber. A higher NRC value indicates that the material provides better sound absorption and reduced sound reflection.

The building panel 10 of the present invention exhibits an NRC of at least about 0.5. In some embodiments, the building panel 10 of the present invention may have an NRC ranging from about 0.60 to about 1.0—including all value and sub-ranges there-between. In a preferred embodiment, the building panel 10 of the present invention may have an NRC ranging from about 0.70 to about 1.0—including all value and sub-ranges there-between.

The body 100 may also exhibit a bulk density as measured by the total weight of the body 100 divided by $V_{Total}$. The bulk density of the body 100 may range from about 72 kg/m$^3$ to about 101 kg/m$^3$—including all densities and sub-ranges there-between. In a preferred embodiment, the bulk density of the body 100 may range from about 77 kg/m$^3$ to about 96 kg/m$^3$—including all densities and sub-ranges there-between. In some embodiments, the bulk density of the body 100 may range from about 86 kg/m$^3$ to about 96 kg/m$^3$—including all densities and sub-ranges there-between.

It has been discovered that the body 100 of the present invention, which is formulated on the previously discussed fibrous material and additional components, results in a ceiling panel 10 that exhibits an improved resistance to fire and smoke spread. Specifically, such improvement in fire and smoke spread values are observed when the body 100 and resulting building panel 10 exhibit one or more of the previously discussed colors.

The ceiling panel 10 of the present invention may exhibit a Class A fire rating based on a flame spread value of <25 as well as a Class A rating based on a smoke developed value of <450. The ceiling panel 10 of the present invention may also exhibit a smoke developed value of less than 400.

The ceiling panel 10 of the present invention may be manufactured by forming the body 100 according to an airlaid process or a carding process. A scrim or other facing layer may then be coupled to the second major surface 112 of the body 100 by an adhesive or fastener. The scrim or other facing layer may then form the second exposed major surface 12 of the ceiling panel 10. According to such embodiments, the first major surface 111 of the body 100 may form the second exposed major surface 12 of the ceiling panel 10. According to such embodiments, the side surface 113 of the body 100 may form the side exposed surface 13 of the ceiling panel 10.

In other embodiments, a coating—such as a paint—may be applied to the second major surface 112 of the body, whereby the coating forms the second exposed major surface 12 of the ceiling panel 10. According to such embodiments, the first major surface 111 of the body 100 may form the second exposed major surface 12 of the ceiling panel 10. According to such embodiments, the side surface 113 of the body 100 may form the side exposed surface 13 of the ceiling panel 10.

In other embodiments, the body 100 may form the entirety of the ceiling panel 10, such that no additional scrim, facing layer, or coating is required to be applied to the second major surface 112 of the body 100—resulting in the second major surface 112 of the body 100 forming the second exposed major surface 12 of the ceiling panel. According to such embodiments, the first major surface 111 of the body 100 may form the second exposed major surface 12 of the ceiling panel 10. According to such embodiments, the side surface 113 of the body 100 may form the side exposed surface 13 of the ceiling panel 10.

The airlaid process or a carding process that forms the body 100 of the present invention may comprise a first step of depositing fibrous material and any additional component onto a first conveyor surface that moves along a machine direction. The fibrous material and additional component may move along the machine direction into a mixing apparatus—such as an airlaid apparatus or a carding apparatus. In the airlaid process, the fibrous material and any additional component are blended together in the presence of pressurized air to form a blend. In the lapping process, the blending process may be facilitated by two or more textured rollers that churn the blend of fibrous material—optionally with the additional component.

The resulting blend may be deposited onto a second conveyor surface in the form of a continuous web having a first thickness. The continuous web may then be passed along the machine direction between two or more compression rolls, whereby the continuous web is compressed to a second thickness. The second thickness may be substantially equal to the body thickness $t_B$. The resulting compressed web may then be cut to size of the body 100 for both the body length $L_B$ and body width $W_B$. A ratio of the second thickness to the first thickness may range from about 1:2 to about 1:20—including all ratios and sub-ranges there-between.

During manufacture, the thermoplastic nature of the polymer fiber may bond together the fibrous material and additional components. Specifically, the blend may be heated to a temperature above the melt temperature of at least one thermoplastic polymer within the fibrous material. The blend may be heated to a temperature ranging from about 110° C. to about 200° C.—including all temperatures and sub-ranges there-between.

Above the melt temperature, the thermoplastic polymer may at least partially melt and contact adjacent fibrous material and additional components. When the blend is cooled below the melt temperature, the resulting fibrous material and additional components are held together.

The fibrous material may be held above the melting temperature at the time when the continuous web passes through the compression rolls, thereby compressing the web while at least some of the fibrous material is in a melted state. Thus, the continuous web may be compressed from the first thickness to the second thickness while in a melted state and then cool to a solidified state in the second thickness (i.e., the body thickness $t_B$), thereby retaining the second thickness. Once cooled to the solidified state, the continuous web may be cut to size for the body width $W_B$ and body length $L_B$.

The body 100 of the ceiling panel 10 of the present invention may also be formed from at least two separate layers—each layer being formed of the previously discussed formulation—whereby each layer may be coupled together by adhesive or a suitable fastener. According to some embodiments, each of the layers that may make up the multi-layer body 100 have a layer thickness that is equal to about 10% to about 50% of the of the body thickness $t_B$ of the overall body 100—whereby when the separate layers are combined, the multi-layer structure has a thickness equal to the body thickness $t_B$.

The panel assembly 50 of the present disclosure may be formed by coupling the magnetic attachment element 20 to the building panel 10 using at least an adhesive 40. The magnetic attachment element 20 may comprise an upper major surface 21 that is opposite a lower major surface 22 and a side surface 23 extending there-between. The magnetic attachment element 20 may have a major dimension—such as a length, a minor dimension—such a width, and a thickness as measured between the upper major surface 21 and the lower major surface 22.

The magnetic attachment element 20 may be a magnet selected from one or more of a neodymium iron boron magnet, a samarium cobalt magnet, an alnico magnet, a ceramic magnet, and a ferrite magnet.

In forming the panel assembly 50, adhesive 30 in a first state may be applied to at least one glue region of the first major exposed surface 11 of the ceiling panel 10. Subsequently, the magnetic attachment element 20 may be positioned within one of the glue regions such that the magnetic attachment element 20 directly contacts the adhesive 30. Once applied and the magnetic attachment element 20 is positioned at least partially within the first region, the adhesive 30 may be cured and transition from the first state to the second state.

The adhesive 30 may be applied at the time of installation of the ceiling panel assembly 50. Stated otherwise, the ceiling panel assembly 50 may be assembled from separate components of the ceiling panel 10, the adhesive 30, and the magnetic attachment element 20 at the time of installation of the ceiling system 1—which may also be referred to "field assembly" of the ceiling panel assembly 50.

The first state of the adhesive 30 may be an uncured reactive composition. Non-limiting examples of the uncured reactive composition include isocyanate-terminated polyurethane prepolymer, unreacted blends of resin and hardener, as well as other reactive compositions that may cure when exposed to moisture under atmospheric conditions. Non-limiting examples of unreacted blends of resin and hardener include epoxy blends that include a reactive resin and a crosslinker. In a non-limiting embodiment, the adhesive in a first state may be isocyanate-terminated polyurethane prepolymer—whereby the isocyanate groups are reactive with water and cure upon exposure to moisture to form urea-linked polyurethane.

Specifically, the adhesive 30 in the first state may be applied directly to the first major exposed surface 11 of the building panel 10 in at least one glue region, and subsequently the lower major surface 22 of the magnetic attachment element 20 may be brought into contact with one of the glue regions such that the lower major surface 22 of the magnetic attachment element 20 contacts the adhesive 30 within the glue region.

In an alternative embodiment, the adhesive 30 in the first state may be applied directly to the lower major surface 22 of the magnetic attachment element 20, whereby the adhesive-applied lower major surface 22 of the magnetic attachment element 20 is then brought into contact with the first major exposed surface 11 of the building panel 10 such that the contact between the magnetic attachment element 20, the adhesive 30, and the building panel 10 forms the at least one glue region.

Once contacted with the first major exposed surface 11 of the building panel 10, the adhesive 20 may flow and penetrate into the body 100 of the building panel 10 to form an internal region 31 of the adhesive 30 that occupies at least some of the voids formed by the network of open pathways 150 within the body—whereby the voids of the body 100 that are occupied by the internal region 31 of the adhesive is a second portion 152 of the network of open pathways within the body 100. Stated otherwise, the panel assembly 50 includes the body 100 having the first portion 151 of the network of open pathways 150—whereby the first portion 151 includes open voids that are empty—as well as the second portion 152 of the network of open pathways 150 that are occupied by the internal region 31 of the adhesive 30.

The adhesive 30 present in the internal region 31 may penetrate into the body 100 from the first major surface 111 of the body 100 to a first depth $D_1$ that ranges from about 1% to about 50% of the panel thickness $t_B$—including all percentages and sub-ranges there-between. In some embodiments, the first depth $D_1$ ranges from about 10% to about 50% of the panel thickness $t_B$—including all percentages and sub-ranges there-between. In some embodiments, the first depth $D_1$ ranges from about 15% to about 45% of the panel thickness $t_B$—including all percentages and sub-ranges there-between.

After application, as the adhesive 30 reacts to transition from the first state to the second state (i.e., cures), the adhesive 30 may undergo both a chemical transformation as well as a physical transformation. In a non-limiting embodiment, the adhesive 30 may be an expansion adhesive 30 that undergoes a change in volume during the curing step (i.e., as the adhesive 30 transitions from the first state to the second state). In such embodiment, the adhesive 30 in the first state may occupy a first volume and the adhesive 30 in the second state may occupy a second volume, whereby the second volume is greater than the first volume. In such embodiment, the adhesive 30 in the first state may exhibit a first density and the adhesive 30 in the second state may exhibit a second density, whereby the second density is less than the first density.

According to some embodiments, when the adhesive 30 is an expansion adhesive, the curing step may increase the volume occupied by the second portion 152 of the network of open pathways 150. According to some embodiments, when the adhesive 30 is an expansion adhesive, the curing step may increase the first depth $D_1$ at which the adhesive penetrates into the body 100 of the ceiling panel 10.

Once contacted with the first major exposed surface 11 of the building panel 10, the adhesive 30 may exist above the first major exposed surface 11 of the building panel 10 to form an external region 32 of the adhesive 30 that does not occupy the internal volume of the body 100. The external region 32 of the adhesive 30 may be at least partially in contact with the side surface 23 of the magnetic attachment element 20.

According to the embodiments where the adhesive 30 is an expansion adhesive, the curing step may also cause the adhesive to contact a greater portion of the side surface 23 of the magnetic attachment element 20.

In the second state, the adhesive 30 may be cohesively bond at least the lower surface 22 of the magnetic attachment element 20 to the first major surface 111 of the body 100. In the second state, the adhesive 30 may be cohesively bond at least the lower surface 22 of the magnetic attachment element 20 to the first major exposed surface 11 of the building panel 10.

In the second state, the internal region 31 of the adhesive 30 may cohesively bond to the fibrous material 140 that is located within the second portion 152 of the network of open pathways 150 of the body 100. In the second state, the internal region 31 of the adhesive 30 may mechanically interlock with the fibrous material 140 that is located within the second portion 152 of the network of open pathways 150 of the body 100—such that the magnetic attachment element 20 is cohesively bonded to the adhesive 30 and the adhesive 30 is mechanically interlocked with the fibrous material 140 that is located within the second portion 152 of the network of open pathways 150 of the body 100.

In the second state, the external region 32 of the adhesive 30 may cohesively bond the side surface 23 of the magnetic attachment element 20 to the first major surface 111 of the body 100. In the second state, the external region 32 of the adhesive 30 may cohesively bond the side surface 23 of the magnetic attachment element 20 to the first major exposed surface 11 of the ceiling panel 10.

Figure 6:
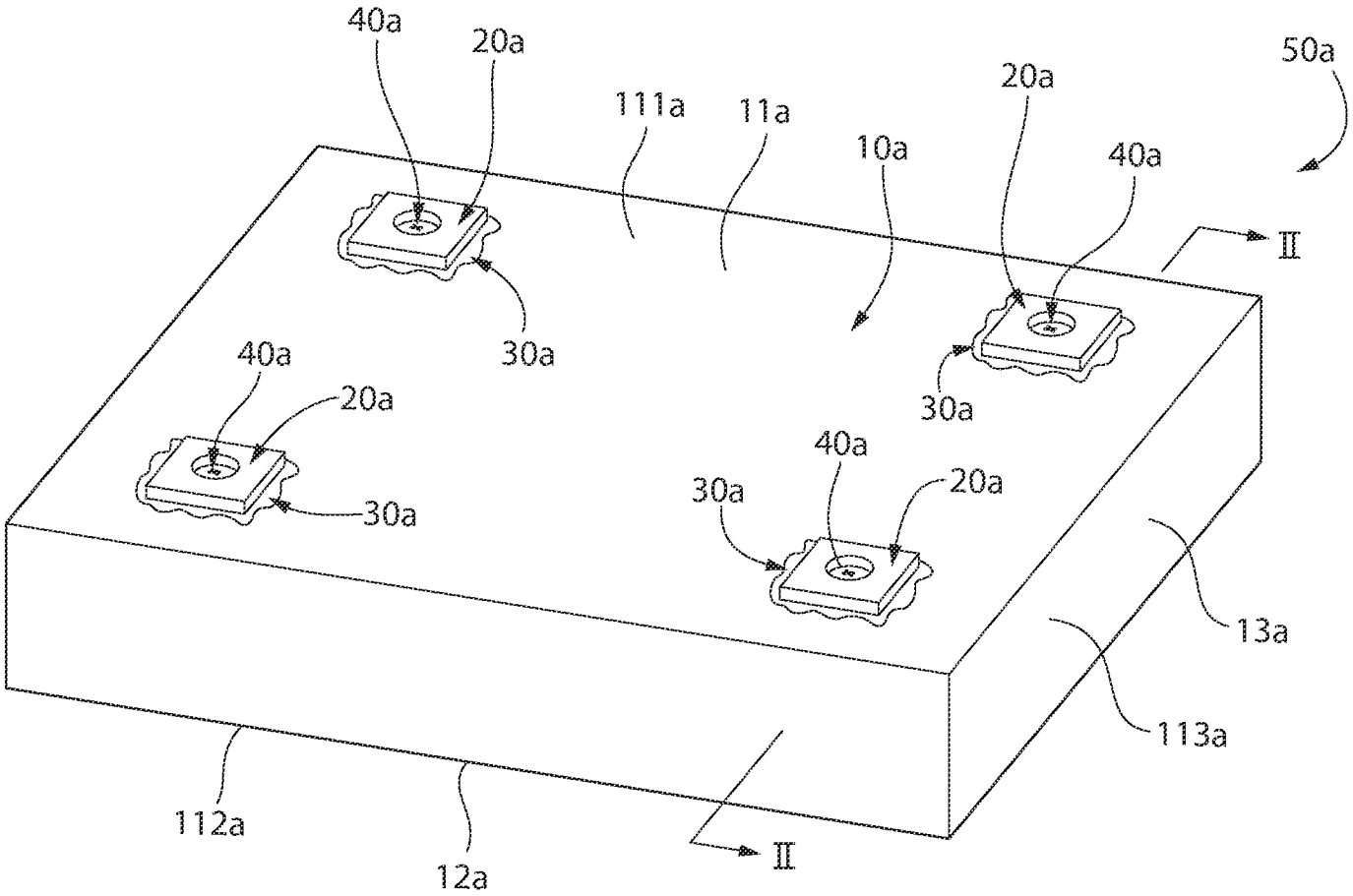
FIG. 6 is a perspective view of an ceiling panel assembly according to another embodiment of the present invention.

Referring now to FIGS. 4-6, the present invention further includes a ceiling system 1 comprising at least one of the ceiling panel assemblies 50. In some embodiments, the ceiling system 1 may comprise a plurality of the ceiling panel assemblies 50. The ceiling system 1 may comprise one or more of the ceiling panel assemblies 50 installed in an interior space, whereby the interior space comprises a plenary space 3 and an active room environment 2. The plenary space 3 is located below the structural ceiling, which is the lower facing surface of the structural separation between floors or a roof of a building—such as a subfloor of an adjacent upper floor, or the roof structure of a building.

The plenary space 3 provides space for mechanical lines within a building (e.g., HVAC, plumbing, etc.). The active space 2 provides room for the building occupants during normal intended use of the building (e.g., in an office building, the active space would be occupied by offices containing computers, lamps, etc.).

In the installed state, the ceiling panel assemblies 50 may be magnetically supported in the interior space via one or more support elements 300. The support elements 300 may comprise a lowermost support surface 310 configured for magnetic attachment to the magnetic attachment element 20 of the ceiling panel assembly 50.

In some embodiments, the support elements 300 may comprise an elongated member 301 that extends longitudinally along a longitudinal axis A-A. The elongated member 301 may comprise the lowermost support surface 310 that also extends along the longitudinal axis A-A. The lowermost support surface 310 of the elongated member 301 may have a width $W_{EM}$ as measured in a direction transverse to the longitudinal axis A-A.

Non-limiting examples of the elongated member 301 include a support strut or an inverted T-bar, whereby the lowermost support surface 310 is the bottom surface of the support strut or the lower face of a bottom flange of the inverted T-bar. The support elements 300 comprise elongated members 301, the ceiling system 1 may comprise a plurality of such elongated members 301 arranged in a parallel array.

Each of the ceiling panel assemblies 50 may be installed by positioning the upper surface 21 of each magnetic attachment element 20 of each ceiling panel assembly 50 adjacent to the lowermost support surface 310 of an elongated member 301. The elongated member 301 may be formed of a ferrous metal, thereby creating an magnetic connection between the elongated member 301 and the magnetic attachment element 20.

The resulting interface between the upper surface 21 of the magnetic attachment element 20 and the lowermost support surface 310 of the elongated member 301 may be substantially free of adhesive.

According to the present invention, the major dimension of the magnetic attachment element may be equal to or less than the width $W_{EM}$ of the elongated member 301. In some embodiments, the major dimension of the magnetic attachment element may be substantially equal to the width $W_{EM}$ of the elongated member 301. In some embodiments, the major dimension of the magnetic attachment element may be less than the width $W_{EM}$ of the elongated member 301. A ratio of the width $W_{EM}$ of the elongated member 301 to the major dimension of the magnetic attachment element may range from about 1.0:1.0 to about 5.0:1.0—including all ratios and sub-ranges there-between. A ratio of the width $W_{EM}$ of the elongated member 301 to the major dimension of the magnetic attachment element may range from about 1.1:1.0 to about 2.0:1.0—including all ratios and sub-ranges there-between.

According to the present invention, the minor dimension of the magnetic attachment element may be equal to or less than the width $W_{EM}$ of the elongated member 301. In some embodiments, the minor dimension of the magnetic attachment element may be substantially equal to the width $W_{EM}$ of the elongated member 301. In some embodiments, the minor dimension of the magnetic attachment element may be less than the width $W_{EM}$ of the elongated member 301. A ratio of the width $W_{EM}$ of the elongated member 301 to the minor dimension of the magnetic attachment element may range from about 1.0:1.0 to about 5.0:1.0—including all ratios and sub-ranges there-between.

Figure 7:
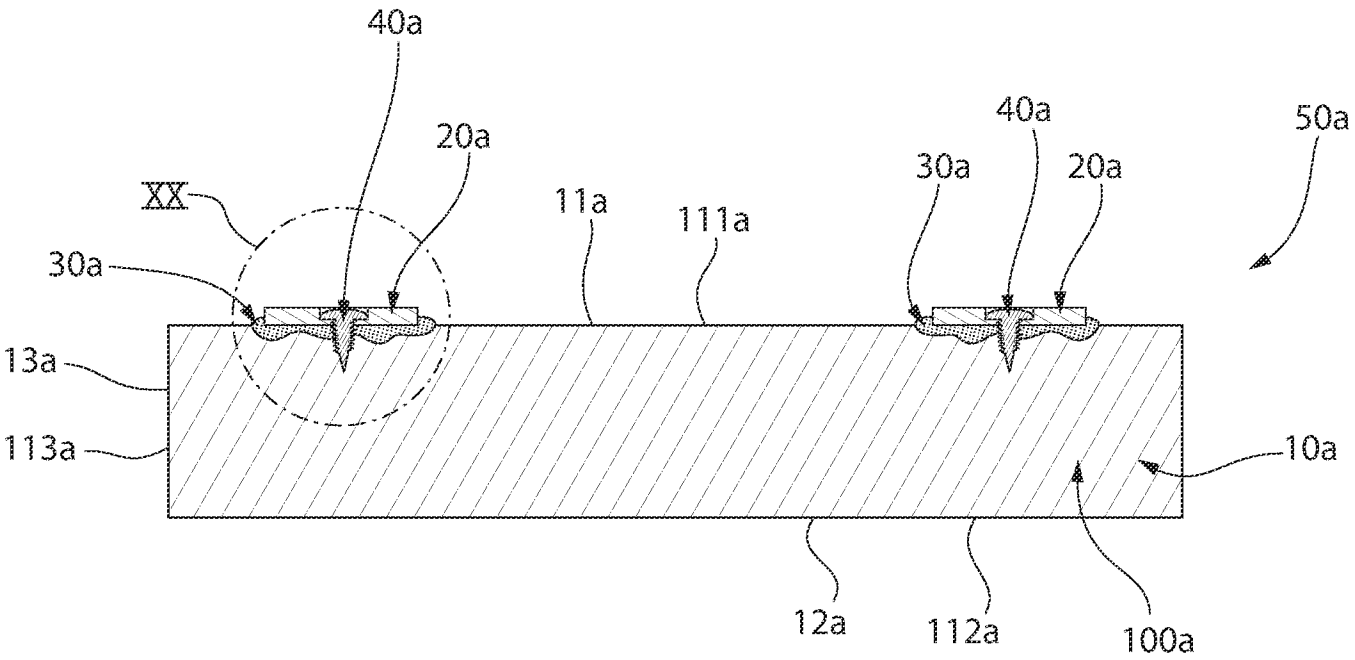
FIG. 7 is a cross-sectional view of the acoustic building panel of FIG. 6 along lines II-II of FIG. 6.
Figure 8:
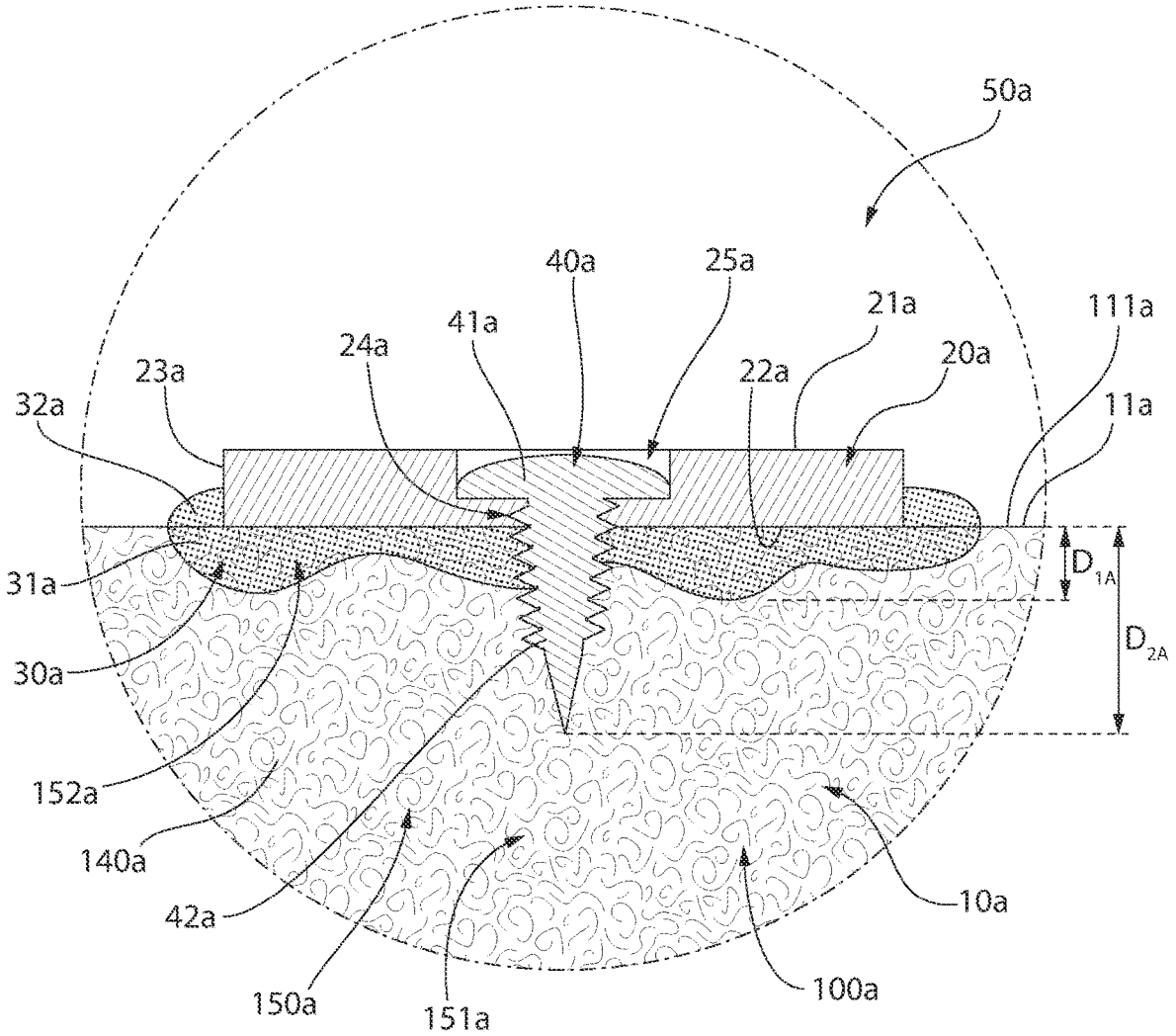
FIG. 8 is a close-up view of the portion XX of FIG. 7.

Referring now to FIGS. 6-8, a ceiling panel assembly 50*a* is illustrated in accordance with another embodiment of the present invention. The ceiling panel assembly 50*a* is similar to the ceiling panel assembly 50 except as described herein below. The description of the ceiling panel assembly 50 above generally applies to the ceiling panel assembly 50*a* described below except with regard to the differences specifically noted below. A similar numbering scheme will be used for the ceiling panel assembly 50*a* as with the ceiling panel assembly 50 except that numbers having the a-suffix will be used.

The panel assembly 50*a* of the present disclosure may be formed by coupling the magnetic attachment element 20*a* to the building panel 10*a* using at least an adhesive 30*a* and a fastener 40*a*. The magnetic attachment element 20*a* may comprise an upper major surface 21*a* that is opposite a lower major surface 22*a*, a side surface 23*a* extending there-between, as well as through-hole 24*a* that continuously extends between the upper major surface 21*a* and the lower major surface 22*a* in a location that is at least partially inset from the side surface 23*a*. In some embodiments, the magnetic attachment element 20*a* may further comprise a counter-sink portion 25*a* formed into the through-hole 24*a*, whereby the counter-sink portion 25*a* is located immediately adjacent to the upper major surface 21*a* of the magnetic attachment element 20*a*.

In forming the panel assembly 50*a*, adhesive 30*a* in the first state may be applied to at least one glue region of the first major exposed surface 11*a* of the ceiling panel 10*a*. Subsequently, the magnetic attachment element 20*a* may be positioned within one of the glue regions such that the magnetic attachment element 20*a* directly contacts the adhesive 30*a*. Subsequently, the fastener 40*a* may be driven through the through-hole 24*a* of the magnetic attachment element 20*a* and into the body 100*a* of the ceiling panel 10*a*, whereby the through-hole 24*a* of the magnetic attachment element 20*a* at least partially overlaps with the glue region in the vertical direction such that the fastener 40*a* at least partially extends through the adhesive 30*a* present in the glue region.

In some embodiments, the fastener 40*a* is inserted through the adhesive 30*a* within the glue region when the adhesive 30*a* is in the first state or at least has not fully transitioned into the second state. In some embodiments, the fastener 40*a* is inserted through the adhesive 30*a* within the glue region when the adhesive 30*a* is in second state.

The fastener 40*a* may comprise a head 41*a* and a securing element 42*a* that extends downward from the head 41*a*. In a non-limiting example, the fastener 40*a* may be a screw comprising a head 41*a* and a securing element 42*a* that is a threaded body. The securing element 42*a* of the fastener 40*a* may extend through the through-hole 24*a* of the magnetic attachment element 20*a* and into the body 100*a* to a second depth $D_{2A}$ as measured from the first major surface 111*a* of the body 100*a* to the distal-most point of the securing element 42*a*.

The second depth $D_{2A}$ may ranges from about 20% to about 80% of the panel thickness $t_B$—including all percentages and sub-ranges there-between. In some embodiments, the second depth $D_{2A}$ may ranges from about 30% to about 80% of the panel thickness $t_B$—including all percentages and sub-ranges there-between. In some embodiments, the second depth $D_{2A}$ may ranges from about 30% to about 75% of the panel thickness $t_B$—including all percentages and sub-ranges there-between.

The head 41*a* of the fastener 40*a* may located entirely within the counter-sink portion 25*a* of the magnetic attachment element 20*a*, thereby resulting in no horizontal overlap between the upper surface 21*a* of the magnetic attachment element and the fastener 40*a*.

The adhesive 30*a* may be applied and the fastener 40*a* secured to the ceiling panel 10*a* at the time of installation of the ceiling panel assembly 50*a*. Stated otherwise, the ceiling panel assembly 50*a* may be assembled from separate components of the ceiling panel 10*a*, the adhesive 30*a*, the fastener 40*a*, and the magnetic attachment element 20*a* at the time of installation of the ceiling system 1*a*—which may also be referred to "field assembly" of the ceiling panel assembly 50*a*.

In some embodiments, the adhesive 30*a* in the first state may be applied directly to the first major exposed surface 11*a* of the building panel 10*a* in the at least one glue region, and subsequently the lower major surface 22*a* of the magnetic attachment element 20*a* may be brought into contact with one of the glue regions such that the lower major surface 22*a* of the magnetic attachment element 20*a* contacts the adhesive 30*a* within the glue region. Subsequently, the fastener 40*a* may be driven into the ceiling panel 10*a* through the glue region, whereby the fastener 40*a* extends through the through-hole 24*a* present in the magnetic attachment element 20*a*.

The adhesive 30*a* may be an expansion adhesive that reacts to transition from the first state to the second state (i.e., cures), thereby undergoing both a chemical transformation as well as a physical transformation. In a non-limiting embodiment, the expansion adhesive 30*a* may undergo a change in volume during the curing step (i.e., as the adhesive 30 transitions from the first state to the second state). In such embodiment, the adhesive 30*a* in the first state may occupy a first volume and the adhesive 30*a* in the second state may occupy a second volume, whereby the second volume is greater than the first volume. In such embodiment, the adhesive 30*a* in the first state may exhibit a first density and the adhesive 30*a* in the second state may exhibit a second density, whereby the second density is less than the first density.

According to some embodiments, when the adhesive 30*a* is an expansion adhesive, the curing step may increase the volume occupied by the second portion 152*a* of the network of open pathways 150*a*. According to some embodiments, when the adhesive 30*a* is an expansion adhesive, the curing step may increase the first depth $D_{1A}$ at which the adhesive penetrates into the body 100*a* of the ceiling panel 10*a*. Additionally, the adhesive 30*a* may expand into the through-hole 24*a* of the magnetic attachment election 20*a* before fully transitioning into the second state such that the adhesive 30*a* is present within the through-hole 24*a* of the magnetic attachment element 20*a* in at least a partially uncured state before the fastener 40*a* is driven through the through-hole 24*a*. In such embodiment, the adhesive 30*a* expands into both of the through-hole 24*a* of the magnetic attachment element 20*a* and the second portion 152*a* of the network of open pathways 150*a* before fully curing (i.e., before fully transitioning from the first state to the second state).

Once contacted with the first major exposed surface 11*a* of the building panel 10*a*, the adhesive 30*a* may flow and penetrate into the body 100*a* of the building panel 10*a* to form an internal region 31*a* of the adhesive 30*a* that occupies at least some of the voids formed by the network of open pathways 150*a* within the body. Driving the fastener 40*a* into the body 100*a* and through the glue region may result in the internal region 31*a* of the adhesive 30*a* to extend to a first depth $D_{1A}$ that ranges from about 1% to about 50% of the panel thickness $t_B$—including all percentages and sub-ranges there-between. In some embodiments, the first depth $D_{1A}$ ranges from about 10% to about 50% of the panel thickness $t_B$—including all percentages and sub-ranges there-between. In some embodiments, the first depth $D_{1A}$ ranges from about 15% to about 45% of the panel thickness $t_B$—including all percentages and sub-ranges there-between.

A ratio of the second depth $D_{2A}$ to the first depth $D_{1A}$ may range from about 1:1 to about 5:1—including all ratios and sub-ranges there-between. The ratio of the second depth $D_{2A}$ to the first depth $D_{1A}$ may range from about 1:1 to about 3:1—including all ratios and sub-ranges there-between. A ratio of the second depth $D_{2A}$ to the first depth $D_{1A}$ may range from about 1:1 to about 2:1—including all ratios and sub-ranges there-between. A ratio of the second depth $D_{2A}$ to the first depth $D_{1A}$ may range from about 1:1 to about 1.5:1—including all ratios and sub-ranges there-between.

In the second state, the adhesive 30*a* may be cohesively bond at least the lower surface 22*a* of the magnetic attachment element 20*a* to the first major surface 111*a* of the body 100*a*. In the second state, the adhesive 30*a* may be cohesively bond at least the lower surface 22*a* of the magnetic attachment element 20*a* to the first major exposed surface 11*a* of the building panel 10*a*.

In the second state, the internal region 31*a* of the adhesive 30*a* may cohesively bond to the fibrous material 140*a* that is located within the second portion 152*a* of the network of open pathways 150*a* of the body 100*a*. In the second state, the internal region 31*a* of the adhesive 30*a* may mechanically interlock with the fibrous material 140*a* that is located within the second portion 152*a* of the network of open pathways 150*a* of the body 100*a* such that the magnetic attachment element 20*a* is cohesively bonded to the adhesive 30*a* and the adhesive 30*a* is mechanically interlocked with the fibrous material 140*a* that is located within the second portion 152 of the network of open pathways 150 of the body 100.

In the second state, the internal region 31*a* of the adhesive 30*a* may cohesively bond the securing element 42*a* of the fastener 40*a* to fibrous material 140*a* that is located within the second portion 152*a* of the network of open pathways 150*a* of the body 100*a*. In the second state, the internal region 31*a* of the adhesive 30*a* may mechanically interlock with both of the threads present on the securing element 42*a* of the fastener 40*a* and the fibrous material 140*a* that is located within the second portion 152*a* of the network of open pathways 150*a* of the body 100*a*.

In the second state, the external region 32*a* of the adhesive 30*a* may cohesively bond the side surface 23*a* of the magnetic attachment element 20*a* to the first major surface 111*a* of the body 100*a*. In the second state, the external region 32*a* of the adhesive 30*a* may cohesively bond the side surface 23*a* of the magnetic attachment element 20*a* to the first major exposed surface 11*a* of the ceiling panel 10*a*.

Although not pictured, according to the embodiments there the building systems form wall surfaces, in the installed state, the first exposed major surface 11 of the building panel 10 may face a wall support surface (such as a stud or pre-existing dry-wall, wall surface) and the second exposed major surface 12 of the building panel 10 may face the active room environment 2—whereby the first and second major exposed surfaces are in a vertical or semi-vertical orientation relative to the active room environment 2.

What is claimed is:

1. A ceiling system comprising:

at least one support member comprising a lower support surface;

at least one ceiling panel assembly comprising:

a ceiling panel comprising a porous body having a first major surface opposite a second major surface and a side surface extending there-between, the porous body having a body thickness as measured between the first and second major surfaces;

a magnetic attachment element; and an adhesive;

wherein the adhesive is configured to couple the magnetic attachment element to the first major surface of the porous body so that the magnetic attachment element at least partially protrudes from the first major surface of the porous body, wherein the adhesive is configured to penetrate into the porous body at a first depth as measured from the first major surface, the first depth being about 1% to about 50% of the body thickness;

wherein the first major surface of the porous body lies in a first plane, and wherein an entirety of the magnetic attachment element is located on a same side of the first plane; and wherein the at least one ceiling panel is configured to be secured in place within the ceiling system by a magnetic engagement between the magnetic attachment element and the at least one support member.

2. The ceiling system according to claim 1, wherein the porous body is formed of a fibrous material, comprises a network of open pathways extending between the first major surface, the second major surface, and the side surface and wherein the adhesive is configured to occupy at least a first portion of the network of open pathways of the porous body.

3. The ceiling system according to claim 2, wherein the porous body is formed of a fibrous material selected from polyester fiber, polyethylene, polypropylene, polyamide, high-density polyethylene ("HDPE"), medium-density polyethylene ("MDPE"), low-density polyethylene ("LDPE"), and linear low-density polyethylene ("LLDPE").

4. The ceiling system according to claim 2, wherein the adhesive present in the first portion of the network of open pathways is configured to surround a first portion of the fibrous material thereby mechanically interlocking together the adhesive and the first portion of the fibrous material.

5. The ceiling system according to claim 1, wherein the porous body has a bulk density ranging from about 86.5 $kg/m^3$ to about 96.1 $kg/m^3$ and a porosity ranging from about 90% to about 97%.

6. The ceiling system according to claim 1, wherein the ceiling panel assembly further comprises a fastener that is configured to extend through the magnetic attachment element and into the ceiling panel so that the fastener is in contact with the adhesive.

7. The ceiling system according claim 6, wherein the fastener is configured to extend into the ceiling panel a second depth as measured from the first major surface, the second depth being about 20% to about 80% of the body thickness, wherein the second depth is greater than the first depth.

8. A ceiling panel assembly comprising:

a ceiling panel comprising a porous body having a first major surface opposite a second major surface and a side surface extending there-between, the porous body having a body thickness as measured between the first and second major surfaces;

a plurality of magnetic attachment elements coupled to the first major surface of the ceiling panel in a spaced apart manner, each of the plurality of magnetic attachment elements coupled to the first major surface of the ceiling panel by:

an adhesive that penetrates into the porous body at a first depth; and a fastener that extends through the magnetic attachment element and into the porous body at a second depth that is greater than the first depth; and wherein the porous body comprises a network of open pathways extending between the first major surface, the second major surface, and the side surface, and wherein the adhesive occupies at least a first portion of the network of open pathways of the porous body.

9. The ceiling panel assembly according to claim 8, wherein the porous body is formed of a fibrous material.

10. The ceiling panel assembly according to claim 8, wherein the adhesive is an expansion material.

11. The ceiling panel assembly according to claim 8, wherein the porous body has a bulk density ranging from about 86.5 $kg/m^3$ to about 96.1 $kg/m^3$ and a porosity ranging from about 90% to about 97%.

12. The ceiling panel assembly according to claim 8, wherein the first depth is from about 15% to about 45% of the body thickness and wherein the second depth is from about 30% to about 75% of the body thickness.

13. The ceiling panel assembly according to claim 8, wherein the fastener is a separate and distinct component from the magnetic attachment element.

14. The ceiling panel assembly according to claim 13, wherein the second depth is about 20% to about 80% of the body thickness.

15. The ceiling panel assembly according to claim 8, wherein an entirety of the magnetic attachment element protrudes beyond the first major surface of the ceiling panel.

16. A method of installing a ceiling system comprising:

a) applying an adhesive onto a first major surface of a ceiling panel at a plurality of glue regions;

b) for each of the plurality of glue regions, providing a magnetic attachment element comprising a top surface, a bottom surface, and a through-hole extending from the top surface to the bottom surface;

c) driving a fastener through the through-hole of the magnetic attachment element and into the ceiling panel at each of the plurality of glue regions to attach the magnetic attachment element to the ceiling panel to form a ceiling panel assembly; and d) magnetically coupling the ceiling panel assembly to at least one suspended support element.

17. The method according to claim 16, wherein during step a) the adhesive penetrates a first depth into the ceiling panel and wherein during step c) the fastener penetrates a second distance into the ceiling panel, the second depth being greater than the first depth.

18. The method according to claim 17, wherein the ceiling panel comprising a second major surface opposite the first major surface and a side surface extending there-between, the ceiling panel further comprising a porous body having a network of open pathways extending between the first major surface, the second major surface, and the side surface, and wherein after step a) the adhesive occupies at least a first portion of the network of open pathways of the porous body.

19. The method according to claim 18, wherein during step a) the adhesive expands during curing into the first portion of the network of open pathways.

* * * * *